US006244198B1

(12) United States Patent
Suominen

(10) Patent No.: US 6,244,198 B1
(45) Date of Patent: Jun. 12, 2001

(54) METHOD AND EQUIPMENT FOR PYROLYTIC TREATMENT OF ORGANIC MATERIAL

(75) Inventor: Hannu Lauri Suominen, Golden, CO (US)

(73) Assignee: BCDE Group Waste Management Ltd., Oy, Helsinki (FI)

( * ) Notice: Subject to any disclaimer, the term of this patent is extended or adjusted under 35 U.S.C. 154(b) by 0 days.

(21) Appl. No.: 09/450,694

(22) Filed: Nov. 30, 1999

(51) Int. Cl.[7] ..... F23G 5/02; F27B 9/02

(52) U.S. Cl. ..... 110/342; 110/219; 110/227; 110/228; 110/229; 110/242; 48/197 R; 48/197 FM; 432/128; 432/133; 432/136; 422/188; 422/189

(58) Field of Search ..... 110/204, 218, 110/219, 220, 224, 227, 228, 229, 242, 286, 289, 342; 48/197 R, 197 FM; 432/128, 133, 136; 422/187, 188, 189, 198, 194, 207

(56) References Cited

U.S. PATENT DOCUMENTS 4,339,999 * 7/1982 Fio Rito et al. ..... 110/226
5,347,958 * 9/1994 Gordon, Jr. ..... 122/20 B
5,695,532 * 12/1997 Johnson et al. ..... 48/203
5,783,046 * 7/1998 Flanigan ..... 201/25
5,802,992 * 9/1998 Doncer ..... 110/341
5,802,993 * 9/1998 Meador ..... 110/345
6,084,139 * 7/2000 Van Der Giessen et al. ..... 585/240

* cited by examiner

*Primary Examiner*—Denise L. Ferensic
*Assistant Examiner*—K. B. Rinehart
(74) *Attorney, Agent, or Firm*—Connolly Bove Lodge & Hutz LLP

(57) ABSTRACT

The present invention refers to a method and an equipment for pyrolytic treatment of organic material comprising a supply storage receiving the organic material to be treated, a number of containers with meshlike walls, each to be charged with a batch of said organic material, a horizontal reactor with a charge gate in one end and a discharge gate in the opposite end, the interior of the reactor being divided by means of internal gates into at least a heating chamber, a pyrolysis chamber, and a cooling chamber, as well as a recovery storage for a solid pyrolytic residue of the organic material, i.e. the pyrolytic coke, the pyrolysis chamber being provided with an outlet pipe for generated pyrolytic gas terminating in a fractionating condenser, said condenser being provided with an outlet for each liquid fraction and an outlet pipe for uncondensed pure pyrolytic gas, which outlet pipe terminates in a gas tank.

26 Claims, 3 Drawing Sheets

METHOD AND EQUIPMENT FOR PYROLYTIC TREATMENT OF ORGANIC MATERIAL

BACKGROUND OF THE INVENTION

This invention refers to a method and equipment for pyrolytic treatment of organic material, such as rubber and plastic wastes, other polymeric wastes, slaughterhouse waste, and other organic wastes.

In a pyrolysis process the organic material is thermally broken down in absence of oxygen at high temperatures of about 500 to 900° C., whereby carbon and hydrocarbon compounds are recovered. Due to the high temperature used in the pyrolysis process it will also be possible to destroy contaminated wastes, without any dangerous exhaust.

There is a lot of pyrolysis methods known in the art, for recovering for instance rejected tires, whereby the tires or rubber waste after size reduction to segments of suitable size are inserted in a big ovenlike reactor for gasification without oxygen supply, which takes place at temperatures from 450 to 600° C. By the pyrolysis process a volatile gas, a so called pyrolytic gas is received, which besides water vapor for instance comprises carbon monoxide, carbon dioxide, paraffines, olefins and some other hydrocarbons, from which pyrolytic gas oil and gas can be recovered. From the solid carbon containing residue, wherein said residue comprises a pyrolytic coke, received in a pyrolysis reactor after the pyrolysis has been carried out, carbon black and/or activated carbon can be produced. The product yield from recovered tires consists substantially of about 20 percent oil, 25 percent gas, about 15 percent steel and other materials, as well as about 40 percent carbon.

A reason why pyrolysis processes hitherto only in very small extent have been used for recovering tires and other rubber material is that the equipment as such requires very big investments and that the price you can get of products which are obtained from rejected tires in such equipment becomes too low in relation to the price you can get of corresponding products produced in a conventional way. Especially concerning the different types of petroleum products, which by a sub-sequent separation step and refining can be produced by the pyrolysis process.

The carbon or the pyrolytic coke which is received as a residue from the pyrolysis process has from an economical point of view proven to be comparable to carbon produced in a conventional way, especially if the carbon obtained by the pyrolysis is further refined to carbon black. Carbon black is used in large amounts as pigment and filler in the plastics and rubber industry.

By condensation of less volatile components in the pyrolytic gas received in the pyrolysis process, so called pyrolytic oil can be obtained, which substantially looks like diesel or light fuel oil but with the difference that it has a relatively high content of sulfur and aromatic hydrocarbons. The high content of sulfur and further occurring impurities can for instance be reduced by filtering and the hydrocarbons compounds can be separated to different fractions by condensation. The temperatures at which oil is condensed from the pyrolytic gas is different depending on the density of the oil but in principle the heavier oil fractions are condensed at temperatures of about 350° C., the middle heavy oils at temperatures of 100 to 350° C. and the light oils at temperatures below 100° C. The condensing oil fractions are led for further storage into special collecting tanks while the remaining noncondensed pyrolytic gas preferably is used as fuel for the recovery equipment.

As mentioned above, some pyrolytic products are so valuable that they can be considered as raw material for further treatment and refining. However, tests have shown that the properties of said pyrolytic products to a great extent are determined already during the pyrolysis process by for instance the temperature, the heating rate, the dwell time in the reactor as well as the cooling rate. Consequently it is desirable to be able to control these parameters very exactly during the present pyrolysis process.

If the coke remaining after the pyrolysis process shall be used as solid fuel screening separates it from steel and glass fiber residue and is led to storage. However, coke which is aimed to be further refined to e.g. carbon black or activated carbon have to be pyrolytically treated in further pyrolysis steps comprising elevation of the temperature to a range of 800 to 900° C. in order to completely remove all possible traces of volatile hydrocarbons from the coke and subsequent temperature degradation.

From U.S. Pat. No. 3,962,045 an equipment for pyrolysis treatment of waste, such as plastics and rubber, is known using recirculating heated pyrolytic gas for heating the waste, whereby the circulating pyrolytic gas is led through a reactor zone in which it is brought to cross a continuous flow of waste passing through the reaction zone. When the gas has passed through the reactor zone a part of the generated pyrolytic gas is led back to a condenser unit to be condensed to liquid phase while another part of the pyrolytic gas is led to a heat exchanger to be reheated and led back through the reactor zone. The coke formed during the pyrolysis process is discharged by means of a screw feeder from the bottom of the reactor zone to a collecting unit. Because the waste is fed continuously through the reactor zone the possibilities to control the pyrolysis process are restricted and the formed coke must from a stored state be further treated in a pyrolysis process by heating to temperatures of the range of 800 to 900° C., if the coke is aimed to be further refined to carbon black or activated carbon. Further the production rate of condensed products will be low, because only a part of formed pyrolytic gas is led through said condenser unit.

It is therefore an object of the present invention to eliminate the above drawbacks by providing a new and improved method for pyrolytic treatment of organic materials of all kinds.

It is another object of the present invention to provide new and improved equipment for carrying out the method according to the invention.

SUMMARY OF THE INVENTION

1. In accordance with the present invention there is provided a method for pyrolytic treatment of organic material comprising the steps of charging a container having meshlike walls with a batch of organic material in a supply storage, inserting the charged container in a heating chamber for pretreating the organic material, in order to eliminate water present in the organic material. When all water has been removed as water vapor from the organic material, the organic material is moved through a first internal gate into a pyrolysis chamber, possible oxygen is removed from the pyrolysis chamber by means of a second inactive gas and the dried material will be heated to and maintained at pyrolysis temperature until thermal breakdown of the organic material is completed. Generated pyrolytic gas is led through a condenser to remove all condensable fractions and the remaining pure pyrolytic gas is led to a gas tank, the container is then moved through another internal gate into a cooling chamber, where the remaining solid part of the organic material, i.e. the pyrolytic coke, is cooled to normal temperature, after cooling the container is moved to and discharged in a recovery storage, whereafter the container is transferred to the supply storage to be charged with a new batch of organic material to be treated.

By means of such a method it is possible to treat all kinds of organic materials in a well controlable way by permitting the organic material to be very carefully preheated and heated until all water has been removed without causing any sudden temperature variations, and the carrying out a controllable and complete thermal breakdown of the organic material during the pyrolysis process, and finally enabling the treated solid rest of the organic material to be cooled carefully and controllably down to normal temperature. Although the treatment of the organic material is carried out batchwise in each chamber of the reactor the effect of carrying out each process stage in a separate chamber will result in a somewhat continuous production of pyrolytic gas and coke. Further it is possible to utilize the heat energy released in the cooling chamber in heating the organic material in the heating chamber.

In accordance with the invention there is also provided an equipment for pyrolytic treatment of organic material comprising a supply storage receiving the organic material to be treated, a number of containers with meshlike walls, each to be charged with a batch of said organic material, a horizontal reactor with a charge gate in one end and a discharge gate in the opposite end, the interior of the reactor being divided by means of internal gates into at least a heating chamber, a pyrolysis chamber, and a cooling chamber, as well as a recovery storage for a solid pyrolytic residue of the organic material, i.e. the pyrolytic coke, the pyrolysis chamber being provided with an outlet pipe for generated pyrolytic gas terminating in a fractionating condenser, said condenser being provided with an outlet for each liquid fraction and an outlet pipe for uncondensed pure pyrolytic gas, which outlet pipe terminates in a gas tank.

Further features of the invention will appear from the attached dependent claims.

DESCRIPTION OF A PREFERRED EMBODIMENT

Figure 1:
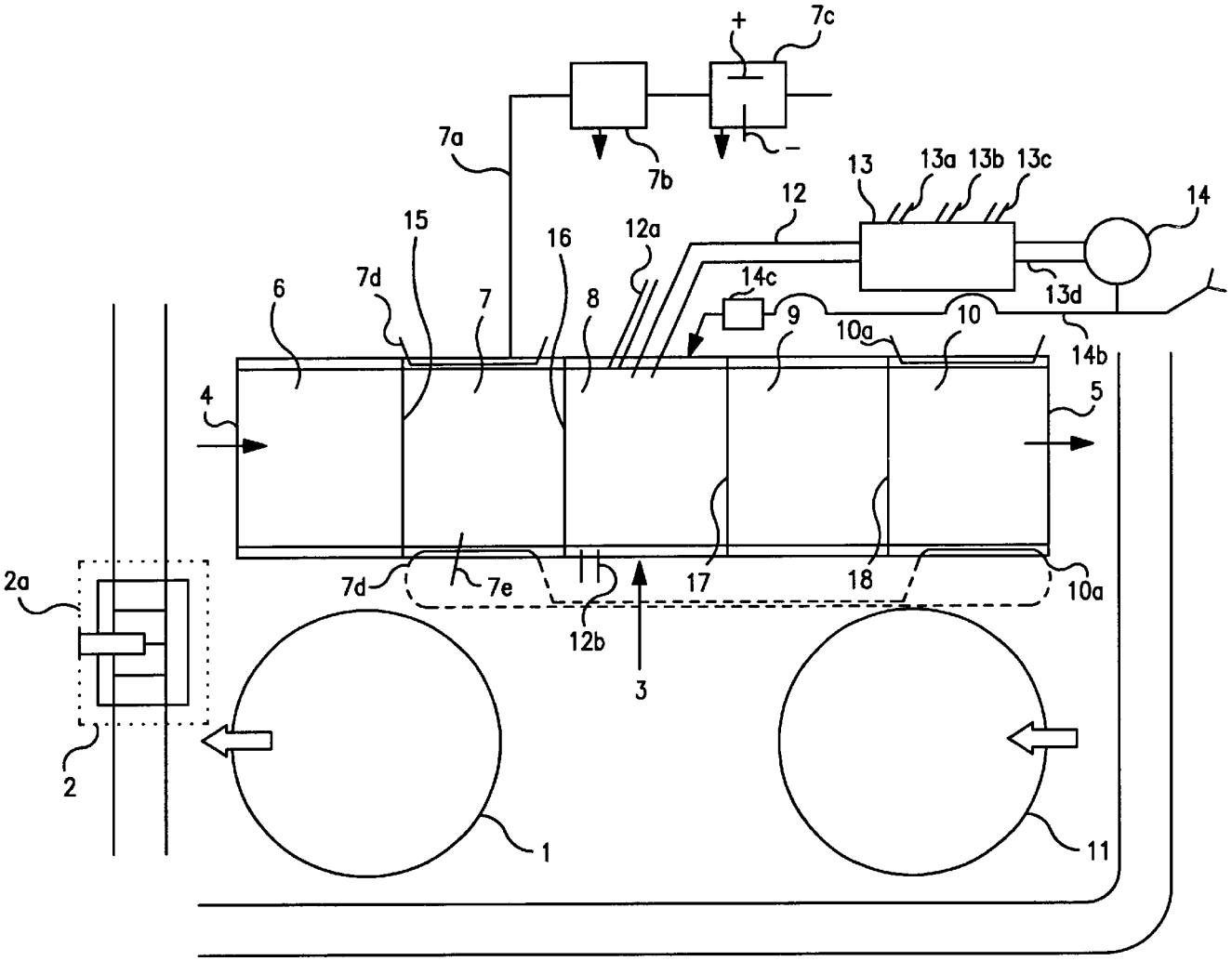
FIG. 1 is a schematic example of a reactor according to the invention.
Figure 2:
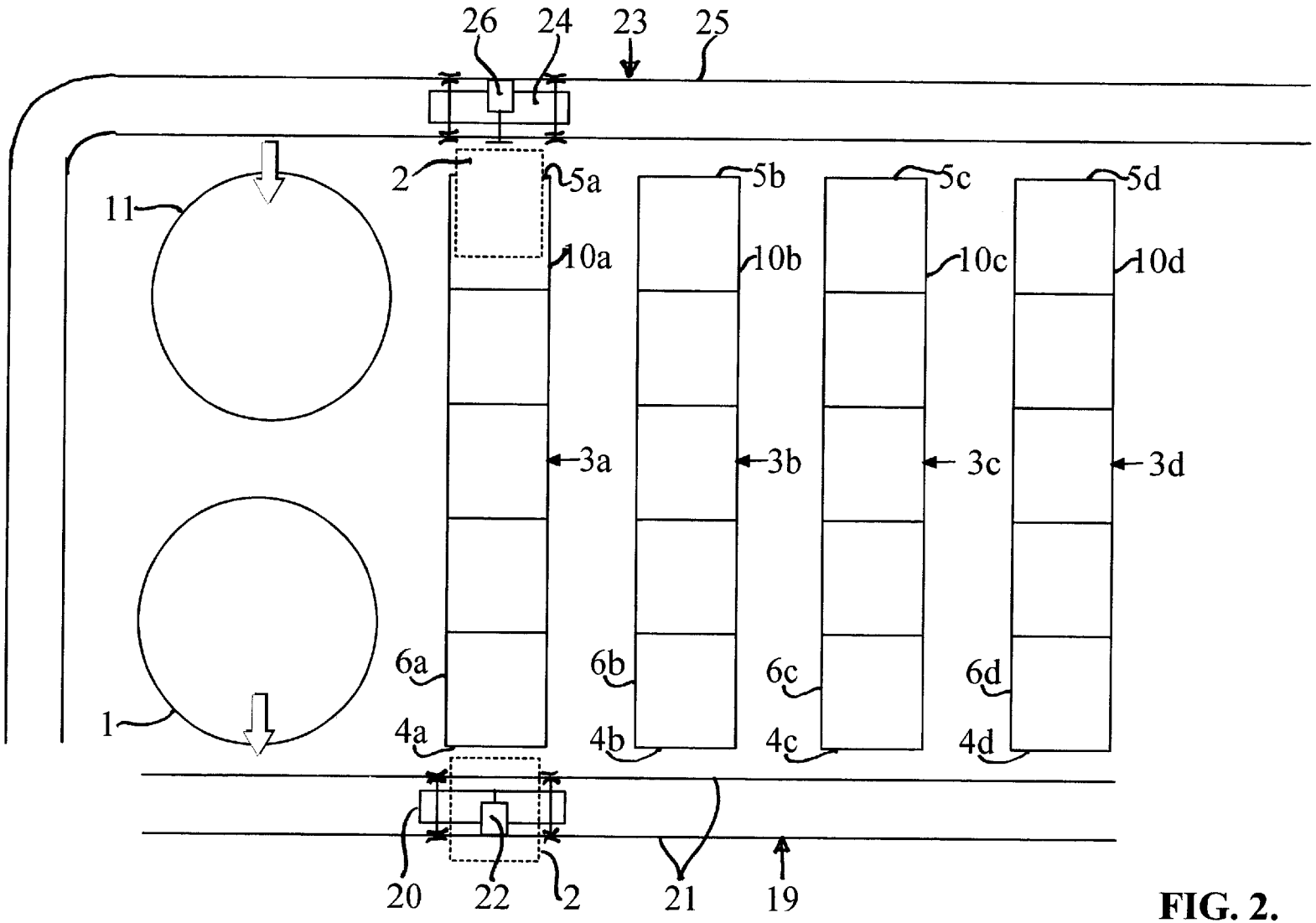
FIG. 2 is an example of equipment according to the invention with a set of parallel horizontal reactors.

For the pyrolytic treatment of organic material according to the invention an equipment is used comprising a supply storage receiving organic material to be treated and a number of containers 2, having mesh wall 2*a*, each of which can be charged with a batch of organic material from the supply storage 1. The organic material brought to the supply storage 1 is size reduced, if necessary, before entering said supply storage 1. Further the equipment is provided with a horizontal reactor 3 having a charge gate 4 in one end and a discharge gate 5 in the opposite end. The interior of the reactor 3 is divided by means of internal gates into at least a heating chamber 7, a pyrolysis chamber 8, and a cooling chamber 10. Preferably the reactor 3 is still provided with a preheating chamber 6 as a first reaction chamber, as well as a precooling chamber 9 directly after the pyrolysis chamber 8. Further the equipment is provided with recovery storage 11 for the solid pyrolytic residue of the organic material, i.e. the pyrolytic coke. The pyrolysis chamber 8 is provided with an outlet pipe 12 for generated pyrolytic gas, said outlet pipe terminating in a fractionating condenser 13 provided with an outlet 13*a*, 13*b*, 13*c* for each liquid fraction, and an outlet pipe 13*d* for uncondensed pure pyrolytic gas terminating in a gas tank 14. Pyrolysis chamber 8 is provided an inlet pipe 12*b* through which an inactive gas is blown into the pyrolysis chamber. Oxygen is sparged from the pyrolysis chamber by being entrained by the blown inert gas and is removed through an outlet pipe 12*a*.

The charged container 2 is inserted through the charge gate 4 into the preheating chamber 6, where the organic material is carefully heated to and maintained at about 80° C. until all exterior water has disappeared as water vapor. Then the container will be moved through a first interior gate 15 into the heating chamber 7, where the temperature of the organic material is carefully increased to a range of about 120° C. to about 180° C. in order to eliminate water present in the organic material. When all water has been removed as water vapor from the organic material the container 2 will be moved through a second internal gate 16 into the pyrolysis chamber 8. Possible oxygen present in the chamber will be removed by introducing an inactive gas into the pyrolysis chamber and the organic material is heated to and maintained at pyrolysis temperature until thermal breakdown of the organic material is completed. The generated pyrolytic gas will be led through the outlet pipe 12 to the fractionating condenser 13 described above, where all condensable fractions are removed and recovered separately. The uncondensable pure pyrolytic gas is led to the gas tank 14. Then the container 2 is moved through a third internal gate 17 into the precooling chamber 9, where the remaining solid part of the organic material, i.e. the pyrolytic coke is carefully cooled to a temperature of about 300° C. whereafter the container is moved through fourth internal gate 18 into the final cooling chamber 10, where the temperature of the solid pyrolytic residue is slowly decreased to normal temperature. Then the container 2 will pass through the discharge gate 5 out of the reactor 3 and will be moved to and discharged in the recovery storage 11. The empty container 2 is then transferred to the supply storage 1 in order to be charged with a new batch of organic material to be treated.

Preferably all chambers 6, 7, 8, 9 and 10 have a size somewhat bigger than the size of the container 2. By dividing the interior of the reactor 3, which is extremely well insulated, into chambers 6, 7, 8, 9 and 10 it is possible to utilize the heat energy released in the cooling chambers 9 and 10 as heating energy in the heating chambers 6 and 7 via exhaust pipe 7*i*. This is achieved by providing the mantle of the heating chambers 6 and 7 with heating tubes 7*f* communicating with cooling tubes 10*c* provided in the mantle of the cooling chambers 9 an 10. Further heating of the organic material in the heating chamber 7 can for instance be carried out by means of microwaves 7*e*.

If the equipment is used for pyrolytic treatment of contaminated organic material, it is preferred to lead the vapor and gases generated in the heating chambers 6 and 7 through a condenser 7*g* and then through an high voltage electric field 7*h* between two electrodes, in order to eliminate all possible contaminated traces from the exhaust. The treatment of contaminated wastes is possible because the charge gate 4 for the contaminated waste to be treated is positioned in one end of the reactor 3 and the discharge gate 5 for the container 2 with pure solid pyrolytic residue of said waste is positioned in the opposite end of the reactor 3. Thus there is no risk that the pure end products of the pyrolysis process will be contaminated with the organic waste to be fed into the reactor 3.

A further advantage with a reactor 3 divided into a plurality of chambers is that as soon as the treatment of the organic material in a container 2 in the first chamber 6 is ready and the container 2 has been moved into the next chamber 7 and the internal gate 15 is shut, a new container charged with a batch of organic material can be inserted into the first chamber 6. Thus it is possible that there is simultaneously a container 2 under treatment in each chamber 6–10. Although the treatment in each reactor is carried out batchwise, the process as a whole will almost have the nature of a continuous process.

The heating of the pyrolysis chamber can be carried out for instance by flowing heated recirculated purified pyrolytic gas through the organic material in the container 2 or the heating can be carried out by flowing a heated medium through heating tubes in the mantle of the pyrolysis chamber. Part of the heated purified pyrolytic gas from tank 14 is recirculated through line 14*b* to pyrolysis chamber 8, in order to heat the organic material. For the heating of said heating medium pyrolytic gas from the same or neighboring equipment can be used. When pyrolytic gas is used as fuel to heat pyrolysis chamber 8 said gas may be generated in the same or neighboring equipment and is conducted through line 14*b* to burner 14*c*.

According to a preferred embodiment the equipment is provided with a set of parallel reactors 3*a*, 3*b*, 3*c* and 3*d*, positioned side by side, all with their charge gates 4*a*–4*d* facing in the same direction. All reactors 3*a*–3*d* are divided into chambers as described above. The parallel reactors 3*a*–3*d* are provided with a common charging system 19 comprising a wagon 20, which is movable back and force along rails 21, extending in front of the charge gates 4*a*–4*d* of each reactor 3*a*–3*d* and in front of the supply storage 1. The wagon 20 is provided with means 22 for picking up a charged container 2 from the supply storage and for pushing said container into the preheating chamber 6*a*–6*d* of that reactor 3*a*–3*d*, which is in turn to be charged, as soon as the wagon 20 has moved from the supply storage 1 and stopped in front of the charge gate 4*a*–4*d* of said reactor 3*a*–3*d*.

Further the set of parallel reactors 3*a*–3*d* is provided with a common discharge system 23 comprising a wagon 24 movable back and force along rails 25 extending in front of the discharge gates 5*a*–5*d* of the reactors and in front of the recovery storage 11 of the equipment and ending near the supply storage 1. The wagon 24 is provided with means 26 for picking up a container 2 with cooled pyrolytic coke from the cooling chamber 10*a*–10*d* of each reactor 3 as soon as a container 2 with pyrolytic coke in a reactor has been cooled to normal temperature, and when the wagon 24 with said container 2 then has been moved to be recovery storage said means 26 are activated to push said container into the recovery storage 11, to discharge said container 2 and remove the empty container 2 from the recovery storage 11, whereafter the wagon 24 will be moved with the empty and clean container 2 back to the supply storage 1 where the container will be charged with a new batch of organic material.

The equipment provided with a set of parallel reactors 3*a*–3*d* is preferably operated to be charged so that the reactors 3*a* to 3*d* are charged and also discharged in turn at a sequence with a constant interval between each charging operation, resulting in an almost continuous feature of the equipment as a whole although each chamber is operated batchwise.

A further advantage of an embodiment with a set of parallel reactors 3*a*–3*d* is that the heat energy from one reactor can be utilized in another of said reactors.

Figure 3:
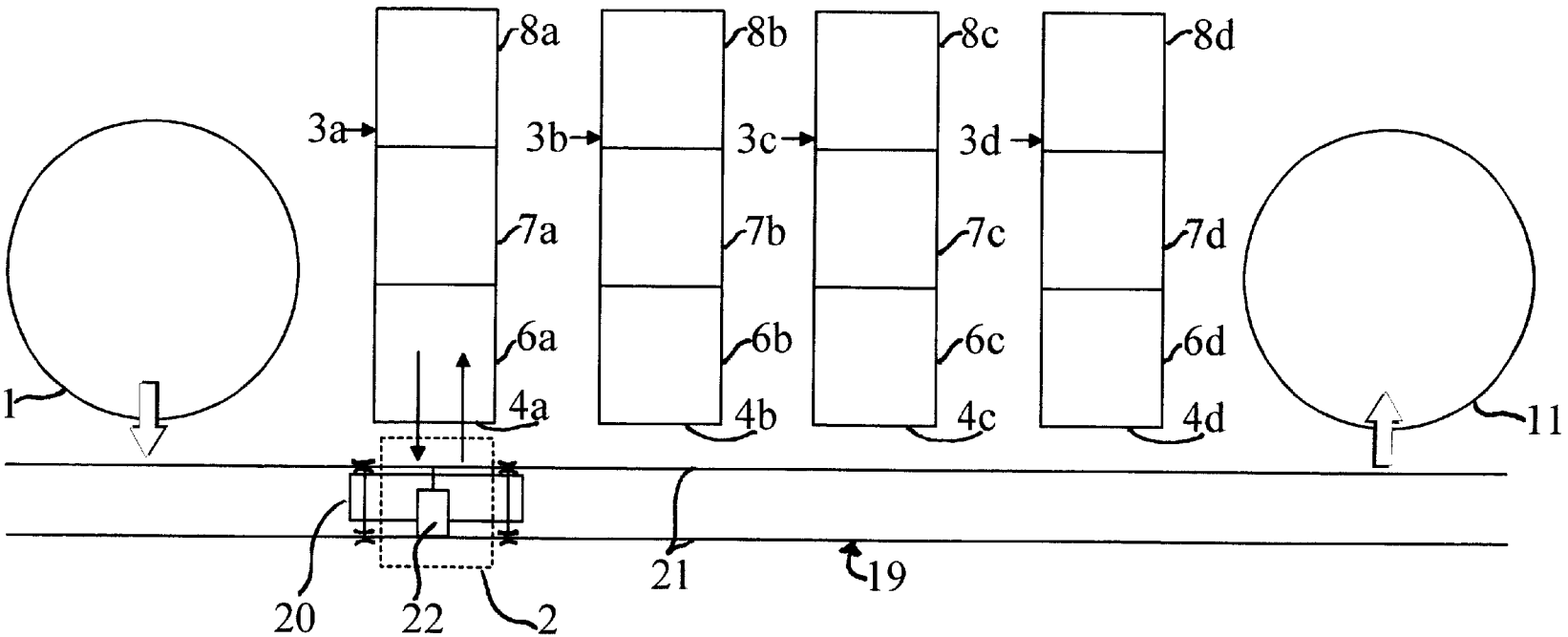
FIG. 3 is an alternative embodiment of the equipment according to the invention with a common charge and discharge device to be used in treating noncontaminated material.

If the organic material to be treated is not contaminated a somewhat simplified embodiment of the equipment with a set of parallel reactors can be used, as shown in FIG. 3. In this embodiment a container 2 with a batch of organic material is pushed through the charge gate 4*a*–4*d* into the heating chamber or into the preheating chamber 6*a*–6*d* of a reactor to be charged if the reactors are provided with a preheating chamber. The process is carried out in the same way as described above, until the thermal breakdown of the organic material in the pyrolysis chamber 8*a*–8*d* is completed. Then the container is moved back to the heating chamber 7*a*–7*d* of the reactor, which now is operating as a precooling chamber. The final cooling is then carried out in the preheating chamber 6*a*–6*d*, if the reactors shown in FIG. 3 are provided with heating chamber 7*a*–7*d* and a preheating chamber 6*a*–6*d*, as indicated in FIG. 3. When the solid pyrolytic residue of the organic material has been cooled to normal temperature the container is drawn out of the preheating chamber 6*a*–6*d* through the charge gate 4*a*–4*b*. During such a process circuit only one container 2 can be present in each reactor 3*a*–3*d* at the same time, but a considerable advantage of such an embodiment is that a common charge and discharge system 19 can be used. The Supply storage 1 is preferably positioned at one of the row of parallel reactors 3*a*–3*d* and the recovery storage 11 is positioned at the opposite end of said row.

On charging a reactor 3*a*–3*d* the wagon 20 is moved to the supply storage 1, catches an empty container 2; pushes it below a discharge opening of said supply storage 1 using the means 22, and will automatically be charged with a batch of organic material to be treated; the means 22 will then draw the charged container out of the supply storage 1 and the wagon 20 will transport the container along the rails 21 into a position in front of the reactor 3*a*–3*d* to be charged; and finally the means 22 will push the container 2 through the charge gate 4*a*–4*d* of that reactor into the preheating chamber 6*a*–6*d* thereof. The wagon will then be moved into position in front of another reactor 3*a*–3*d*,which is in turn to be discharged. The means 22 will then draw out the container 2 with the cooled solid pyrolytic residue of the organic material treated in said reactor 3*a*–3*d*. The container will be moved by the wagon 20 to the recovery storage 11, whereby means 22 will push the container 2 into position above a charge opening of said recovery storage 11 and discharge the container 2 by tipping, whereafter the wagon 20 will move the empty container 2 back to the supply storage 1 in order to be charged with a new batch of organic material to be treated in the next reactor to be charged and so on.

What is claimed is:

1. Method for pyrolysis of organic material comprising the steps of:

providing a supply of organic material;

providing a container having walls;

providing a heating chamber, a pyrolysis chamber, and a cooling chamber, wherein said heating chamber and said pyrolysis chamber are connected by a first internal gate and wherein said pyrolysis chamber and said cooling chamber are connected by a second internal gate;

providing a condenser;

providing a pyrolytic gas tank;

providing a recovery storage;

charging said container with organic material;

heating said container in said heating chamber;

placing said container into said pyrolytic chamber;

closing said first and second gates;

sparging oxygen from said pyrolysis chamber;

heating and maintaining said organic material at pyrolysis temperature forming pyrolytic gas, condensible fractions, and pyrolytic coke;

conducting said pyrolytic gas and said condensible fractions to said condenser and removing said condensible fractions;

conducting purified, pyrolytic gas to said pyrolytic gas tank;

removing said container to said cooling chamber and cooling said pyrolytic coke;

discharging said pyrolytic coke to said recovery storage; and charging said container with organic material.

2. Method according to claim 1 wherein the heating is carried out in two separate steps, in a preheating chamber at a temperature of about 80° C. and then in a main heating chamber at a temperature of about 120° C. to about 180° C.

3. Method according to claim 2 wherein the cooling is carried out in two separate steps, in a precooling chamber to a temperature of about 300° C. and then in a final cooling chamber to ambient temperature.

4. Method according to claim 1 wherein heat energy released in the cooling chamber is utilized in the heating chamber.

5. Method according to claim 1 wherein water vapor and possible gases released during the heating step are purified by condensing and by means of a high voltage electric field.

6. Method according to claim 1, further comprising a plurality of charged containers, wherein an $N+1^{th}$ charged container is inserted into said heating chamber as soon as an $N^{th}$ container has been moved from said heating chamber into said pyrolysis chamber and said first internal gate has been shut.

7. Method according to claim 1 wherein a set of parallel reactors, each comprising one or two heating chambers, a pyrolysis reactor and one or two cooling chambers, said reactors having a common charging system charging the containers for each reactor with a batch of organic material to be treated, transporting the container to the heating chamber of a reactor, which is in turn to be charged, and inserting the container into said heating chamber.

8. Method according to claim 7, wherein the set of parallel reactors are provided with a common discharge system comprising picking up a container with cooled pyrolytic coke from the cooling chamber of each reactor, transporting the container to a recovery storage, discharging the container and transporting the empty container back to the supply storage.

9. Method according to claim 8, wherein the reactors are charged and discharged, respectively, in turn at a sequence with a constant interval between each charging operation.

10. Method according to claim 9, wherein the heat energy from one reactor can be utilized in another of said reactors.

11. Method according to claim 1, wherein the organic material to be treated has been size reduced before entering the supply storage.

12. Equipment for pyrolysis of organic material comprising:

means for storing organic material;

a horizontal reactor comprising a charge gate at a first end and a discharge gate at a second end, and first and second internal gates dividing the reactor into heating, pyrolysis, and cooling chambers said cooling chamber having a cooling mantle; said heating chamber for heating said organic material, said pyrolysis chamber for pyrolyzing said organic material, and said cooling chamber for cooling said organic material;

a plurality of containers to convey said organic material through said reactor, said container having walls;

a pyrolysis gas condenser and a pyrolysis gas storage tank;

a sparge gas inlet pipe and a sparge gas outlet pipe connected to said pyrolysis chamber;

a pyrolysis gas outlet pipe connecting said pyrolysis chamber and said condenser;

a plurality of condensed fraction storage means;

a plurality of condensed fraction outlet pipes connecting said condenser and said condensed fraction storage means;

a condenser outlet pipe connecting said condenser and said pyrolysis gas storage tank; and means for storing pyrolytic coke.

13. Equipment according to claim 12, wherein the reactor is provided with a preheating chamber, a main heating chamber, a precooling chamber, and a final cooling chamber.

14. Equipment according to claim 12 wherein there is a set of parallel reactors, positioned side by side, all of the reactors with charge gates facing in the same direction, each reactor comprising one or two heating chambers, a pyrolysis chamber and one or two cooling chambers, said set of parallel reactors being provided with a common charging system comprising a wagon movable back and force along rails extending in front of the charge gates of each reactor and in front of a common supply storage, said wagon being provided with means for picking up a charged container from said common supply storage and pushing said charged container through a charge gate into the first chamber of a reactor in turn to be charged.

15. Equipment according to claim 14, wherein the set of parallel reactors is provided with a common discharge system, comprising a wagon moving back and force along rails extending in front of the discharge gates of each reactor and in front of a common recovery storage and ending near the common supply storage, said wagon being provided with means for picking up a container with cooled pyrolytic coke from the cooling chamber of each of said reactors as soon as a container with pyrolytic coke in a reactor has been cooled to normal temperature, and for pushing said container into the common recovery storage, discharging the container and removing it from the recovery storage and pushing said container into the supply storage in order to be charged with a new batch of organic material.

16. Equipment according to claim 12, wherein said heating chamber comprises a heating mantle wherein said heating mantle is provided with heating tubes and said cooling mantle is provided cooling tubes, wherein said heating tubes and said cooling tubes communicate.

17. Equipment according to claim 12, wherein the heating chamber is provided with an exhaust pipe for generated vapor and gases, said exhaust pipe being provided with a condenser and a high voltage electric field between two electrodes.

18. Equipment according to claim 12, wherein the heating of the organic material in the heating chamber is carried out by means of microwaves.

19. Equipment according to claim 12, wherein each chamber has a size somewhat bigger than the size of said containers.

20. Equipment according to claim 12, wherein the heating of the organic material in the pyrolysis chamber is carried out by means of heated recirculated purified pyrolytic gas.

21. Equipment according to claim 12, wherein purified pyrolytic gas generated in the same or neighboring equipment is used as fuel in heating the pyrolysis chamber.

22. Equipment according to claim 12, wherein the reactor is provided with a common charge and discharge gate, whereby the interior of the reactor is divided in at least two chambers.

23. Equipment according to claim 22, wherein there is a set of parallel reactors with their charge and discharge openings facing in the same direction , said equipment being provided with a common charge and discharge system for charging a container with organic material, bringing said charged container into a first chamber of a reactor and taking a container with solid pyrolytic residue of organic material from another reactor, discharging the reactor into the recovery storage at the opposite end of the row of reactors and bringing the empty container back to the supply storage for a new batch of material to be treated.

24. Equipment for pyrolysis of organic material, according to claim 22, wherein said interior of the reactor is divided into three chambers.

25. A method for pyrolysis of organic material, according to claim 1, wherein said walls have a pattern of openings.

26. Equipment for pyrolysis of organic material, according to claim 12, wherein said walls have a pattern of openings.

* * * * *